US007730570B1

(12) United States Patent
Billups

(10) Patent No.: US 7,730,570 B1
(45) Date of Patent: Jun. 8, 2010

(54) BODY SCRUBBING APPARATUS

(76) Inventor: Anthony L. Billups, 13410 S. Kominsky Ave., Robbins, IL (US) 60472

( * ) Notice: Subject to any disclaimer, the term of this patent is extended or adjusted under 35 U.S.C. 154(b) by 1810 days.

(21) Appl. No.: 10/789,612

(22) Filed: Feb. 27, 2004

(51) Int. Cl.
*A47L 25/00* (2006.01)
*A47K 7/00* (2006.01)
*A47K 7/04* (2006.01)

(52) U.S. Cl. ..... 15/144.4; 15/176.1; 15/176.6; 15/145; 15/160; 15/184; D4/132; D32/51

(58) Field of Classification Search ..... 15/176.1, 15/176.6, 187, 188, 160, 159.1, 184, 228, 15/144.4, 145, 144.3, 164, 244.1; D4/127, D4/128, 130, 132, 133, 134; D32/51
See application file for complete search history.

(56) References Cited

U.S. PATENT DOCUMENTS 2,736,915 A * 3/1956 Le Febvre et al. ..... 15/147.1
2,795,807 A * 6/1957 Salvy ..... 15/176.1
3,128,487 A * 4/1964 Vallis ..... 15/176.1
3,134,121 A * 5/1964 Wachtel ..... 15/176.1
4,392,269 A * 7/1983 Nishiyama et al. ..... 15/145
4,618,443 A * 10/1986 Jude ..... 15/104.94
4,658,461 A * 4/1987 Roe et al. ..... 15/210.1
5,083,840 A * 1/1992 Young et al. ..... 300/21
5,479,951 A * 1/1996 Denebeim ..... 132/265
5,671,497 A 9/1997 Abdo
5,673,455 A 10/1997 Per-Lee et al.
5,791,006 A * 8/1998 Anctil ..... 15/144.4
5,887,314 A 3/1999 Jordan, Jr.
6,415,470 B1 7/2002 Ramrattan
6,845,539 B2 * 1/2005 Tubman ..... 15/159.1
2004/0074033 A1 * 4/2004 Steinberg ..... 15/144.4
2004/0117933 A1 * 6/2004 Tubman ..... 15/160

* cited by examiner

*Primary Examiner*—Gary K Graham

(57) ABSTRACT

A body scrubbing apparatus for facilitating cleaning of areas of a body not readily accessible when the user is bathing. The body scrubbing apparatus includes a handle member being designed for being gripped by a hand of the user. A head member is coupled to the handle member whereby the head member is designed for being positioned opposite the hand of the user when the handle member is being gripped by the user. A scrubbing member is selectively mounted to the head member. The scrubbing member is designed for scrubbing against the user for facilitating cleaning of the user when the scrubbing member is mounted to the head member. The scrubbing member is selectively replaced when the scrubbing member is removed from the head member.

7 Claims, 4 Drawing Sheets

BODY SCRUBBING APPARATUS

BACKGROUND OF THE INVENTION

1. Field of the Invention

The present invention relates to back scrubbing devices and more particularly pertains to a new body scrubbing apparatus for facilitating cleaning of areas of a body not readily accessible when the user is bathing.

2. Description of the Prior Art

The use of back scrubbing devices is known in the prior art. U.S. Pat. No. 5,887,314 describes a device for varying the length of a handle to provide greater ease of using an attachment end. Another type of back scrubbing device is U.S. Pat. No. 5,673,455 having an applicator with attachment that are selectively threaded onto the applicator. U.S. Pat. No. 5,671,497 has an applicator with bendable section between the applicator and a removable attachment member to allow the attachment member to conform to the body of the user. U.S. Pat. No. 6,415,470 has a handle with an adjustable length coupled to a backing member and selectively receives a pad that is used to apply lotion to a user.

While these devices fulfill their respective, particular objectives and requirements, the need remains for a device that has certain improved features that allows alignment of the replaceable bristles with the head when replaced.

SUMMARY OF THE INVENTION

The present invention meets the needs presented above by providing the head member with channels to allow the scrubbing member to be aligned with the head member each time the scrubbing member is mounted to the head member.

Still yet another object of the present invention is to provide a new body scrubbing apparatus that allows the length the changed to accommodate areas that cannot be readily reached.

Even still another object of the present invention is to provide a new body scrubbing apparatus that allows the user to replace the scrubbing member when the bristles of the scrubbing member are no longer effective at cleaning the skin of the user.

To this end, the present invention generally comprises a handle member being designed for being gripped by a hand of the user. A head member is coupled to the handle member whereby the head member is designed for being positioned opposite the hand of the user when the handle member is being gripped by the user. A scrubbing member is selectively mounted to the head member. The scrubbing member is designed for scrubbing against the user for facilitating cleaning of the user when the scrubbing member is mounted to the head member. The scrubbing member is selectively replaced when the scrubbing member is removed from the head member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
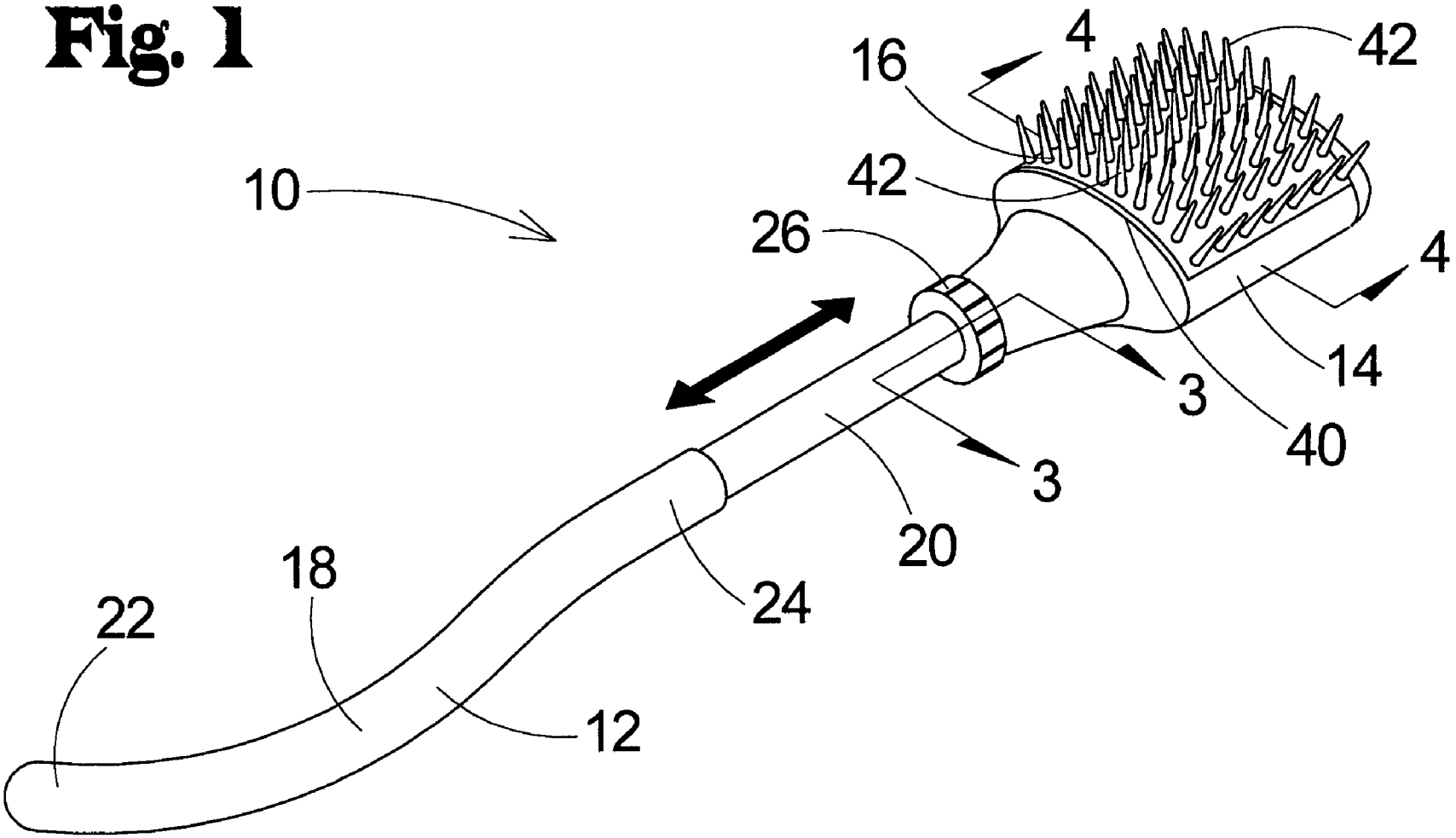
FIG. 1 is a perspective view of a new body scrubbing apparatus according to the present invention.
Figure 2:
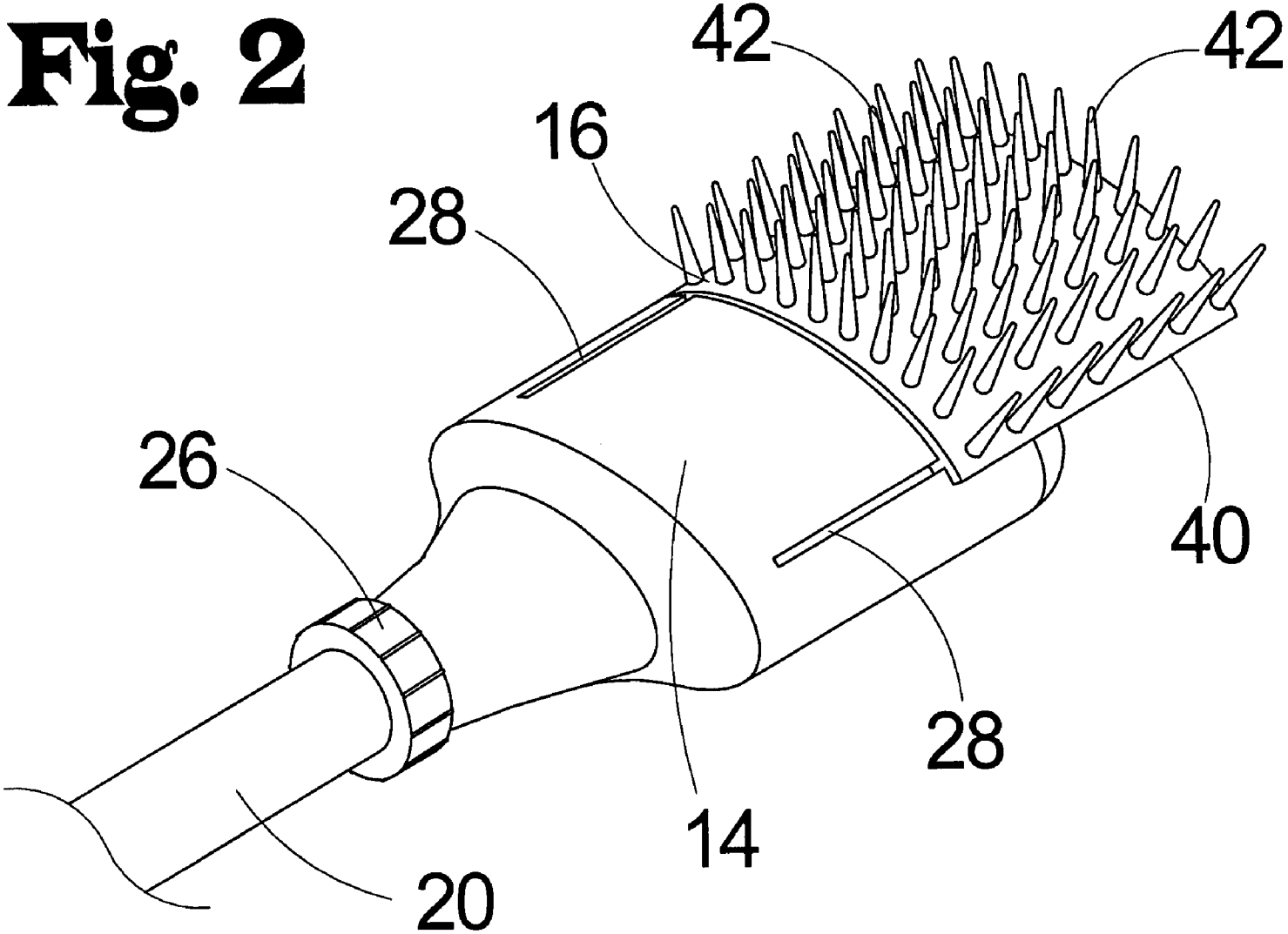
FIG. 2 is an enlarge perspective view of the scrubbing member being removed from the head member of the present invention.
Figure 3:
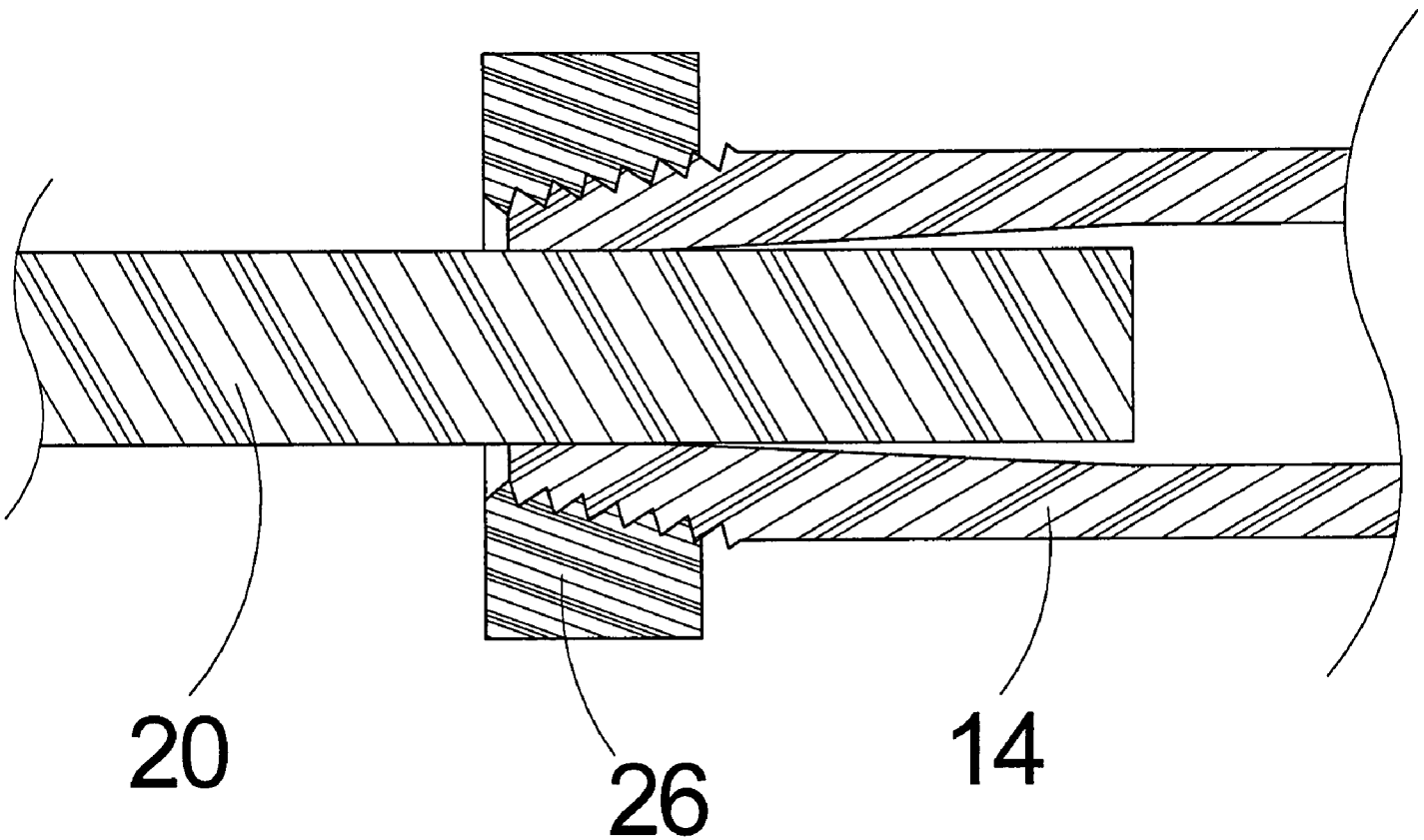
FIG. 3 is a cross-sectional view of the present invention taken along line 3-3 of FIG. 1.
Figure 4:
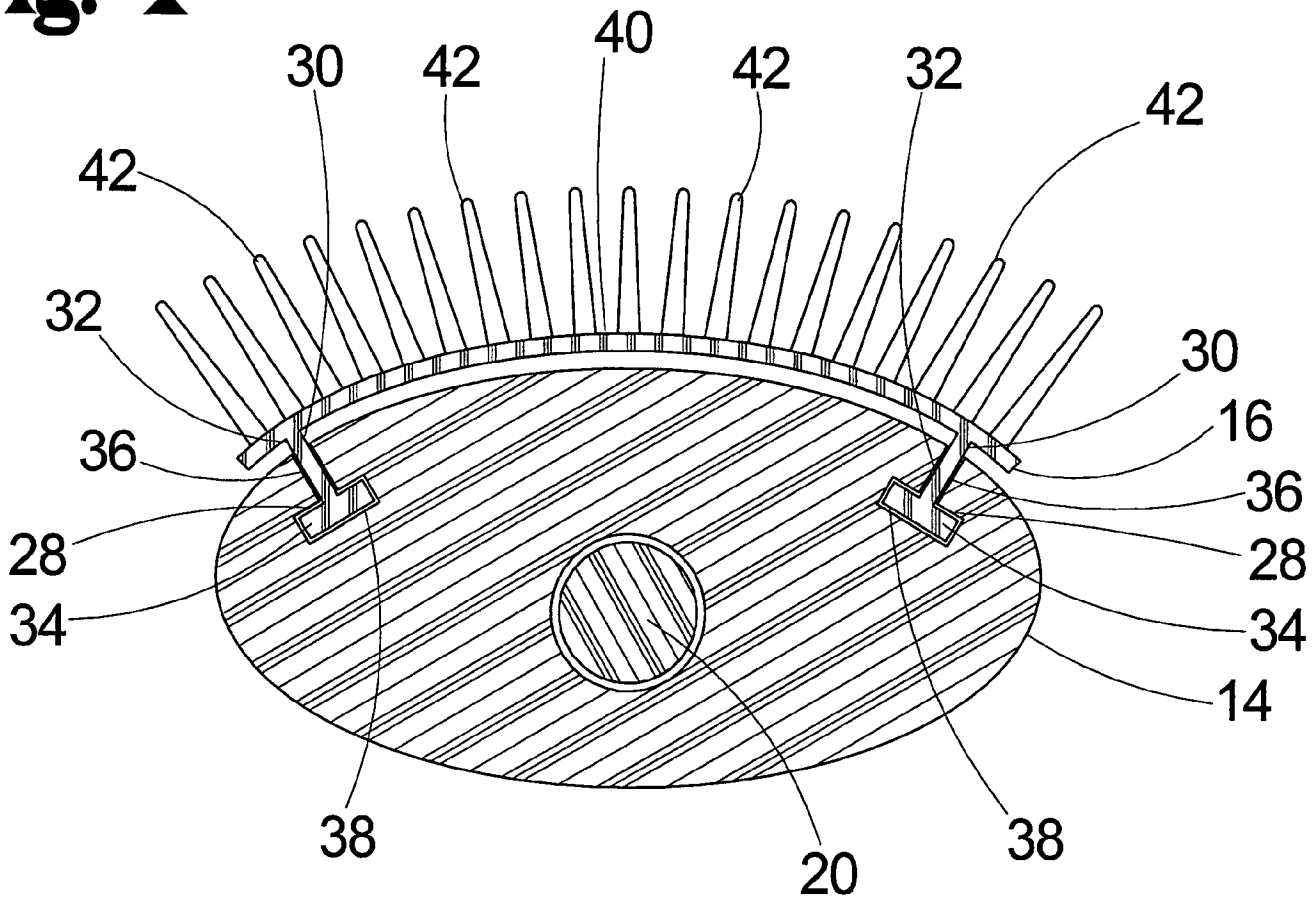
FIG. 4 is a cross-sectional view of the present invention taken along line 4-4 of FIG. 1.

With reference now to the drawings, and in particular to FIGS. 1 through 4 thereof, a new body scrubbing apparatus embodying the principles and concepts of the present invention and generally designated by the reference numeral 10 will be described.

As best illustrated in FIGS. 1 through 4, the body scrubbing apparatus 10 generally comprises a handle member 12 being designed for being gripped by a hand of the user.

A head member 14 is coupled to the handle member 12 whereby the head member 14 is designed for being positioned opposite the hand of the user when the handle member 12 is being gripped by the user.

A scrubbing member 16 is selectively mounted to the head member 14. The scrubbing member 16 is designed for scrubbing against the user for facilitating cleaning of the user when the scrubbing member 16 is mounted to the head member 14. The scrubbing member 16 is selectively replaced when the scrubbing member 16 is removed from the head member 14.

The handle member 12 comprises a gripping portion 18 and an extension portion 20. The gripping portion 18 is designed for being gripped by the hand of the user. The extension portion 20 is coupled to the extension portion 20. The extension portion 20 extends into the head member 14 whereby the head member 14 is selectively positionable along a length of the extension member to selectively change a distance between the gripping portion 18 and the head member 14 to reach areas of the body not readily accessible.

The gripping portion 18 comprises an arcuate portion 22 and a straight portion 24. The straight portion 24 is coupled to the extension portion 20. The arcuate portion 22 is coupled to the straight portion 24 opposite the extension portion 20. The arcuate portion 22 is curved whereby the arcuate portion 22 is designed for being gripped by the user to provide a comfortable grip for the user.

A locking member 26 is operationally coupled to the head member 14. The locking member 26 selectively engages the extension portion 20 whereby the locking member 26 is for inhibiting movement of the head member 14 with respect to the extension portion 20 when the locking member 26 is actuated by the user to selectively engage the extension portion 20.

The locking member 26 extends around the extension portion 20. The locking member 26 is threadably coupled to the head member 14 whereby rotation of the locking member 26 in a first direction forces the head member 14 against the extension portion 20 of the handle member 12 to frictionally engage the head portion to the extension portion 20 to inhibit inadvertent sliding of the head member 14 with respect to the extension portion 20 of the handle member 12.

The head member 14 comprises a pair of channels 28 extending into the head member 14. A pair of mounting members 30 are coupled to the scrubbing member 16. One of the mounting members 30 is selectively inserted into one of the channels 28 of the head member 14 to selectively mount the scrubbing member 16 to the head member 14.

Each of the mounting members 30 comprises a base portion 32 and a scrubbing portion 34. The base portion 32 is coupled to the scrubbing member 16. The securing portion 34 is coupled to the base portion 32 of the associated one of the mounting members 30 opposite the scrubbing member 16 whereby the securing portion 34 is positioned at an angle to the base portion 32.

Each of the channels 28 of the head member 14 comprises a vertical portion 36 and an angled portion 38. The angled portion 38 is positioned at an angle to the vertical portion 36 of the associated one of the channels 28. The vertical portion 36 of each of the channels 28 is for slidably receiving the base portion 32 of the associated one of the mounting members 30 whereby the angled portion 38 slidably receives the securing portion 34 of the associated one of the mounting member. The securing portion 34 is inhibited from being pulled through the vertical portion 36 of the associated one of the channels 28 to inhibit inadvertent separation of the scrubbing member 16 from the head member 14.

The scrubbing member 16 comprises a main portion 40 and a plurality of bristles 42. The main portion 40 is selectively mounted to the head member 14. Each of the bristles 42 is coupled to the main portion 40 of the scrubbing member 16 whereby each of the bristles 42 extending outwardly from the main portion 40. The bristles 42 is designed for scrubbing against the skin of the user to clean the skin of the user. The main portion 40 of the scrubbing member 16 may be provided in plurality of shapes with bristles 42 in varying coarseness to provide varying degrees of scrubbing.

In use, the user rotates the locking member 26 and slides the head member 14 along the extension portion 20 to the desired length. The locking member 26 is rotated in the opposite direction to secure the head member 14 in the desired location. The mounting members 30 are slid into the channels 28 of the head member 14 to secure the scrubbing member 16 to the head member 14. The bristles 42 of the scrubbing member 16 are then scrubbed against the skin of the user while bathing to facilitate cleaning of areas that are not readily accessible by the user. As the bristles 42 become worn over continued use the user removes the scrubbing member 16 from the head member 14 and replaces the scrubbing member 16 with a new scrubbing member 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A body scrubbing apparatus for scrubbing parts of a body of a user not readily accessible during bathing, the body scrubbing apparatus comprising:

an elongated handle member having a substantially transverse cross section, said handle member being adapted for being gripped by a hand of the user;

a head member being coupled to said handle member such that said head member is adapted for being positioned opposite the hand of the user when said handle member is being gripped by the user, a channel being formed in said head member, the channel having an opening in communication with an exterior of said head member;

a scrubbing member being removably mounted to said head member, said scrubbing member comprising a main portion defining spaced end edges and spaced free edges, said scrubbing member being adapted for scrubbing against the user for facilitating cleaning of the user when said scrubbing member is mounted to said head member, said scrubbing member being replacable by removing said scrubbing member is removed from said head member;

said handle member comprising a gripping portion and an extension portion, said gripping portion being adapted for being gripped by the hand of the user, said gripping portion being coupled to said extension portion, said extension portion extending into said head member through said cross section such that said head member is selectively positionable along a length of said extension member to selectively change a distance between said gripping portion and said head member to reach areas of the body not readily accessible;

said gripping portion comprising an arcuate portion and a straight portion, said straight portion being coupled to said extension portion, said arcuate portion being coupled to said straight portion opposite said extension portion, said arcuate portion being curved such that said arcuate portion is adapted for being gripped by the user to provide a comfortable grip for the user;

a locking member being operationally coupled to said head member adjacent to the opening of said channel, said locking member selectively engaging said extension portion such that said locking member is for inhibiting movement of said head member with respect to said extension portion when said locking member is actuated by the user to selectively engage said extension portion;

said locking member extending around said extension portion, said locking member being threadably coupled to said head member such that rotation of said locking member in a first direction forces said head member against said extension portion of said handle member to frictionally engage said head portion to said extension portion to inhibit inadvertent sliding of said head portion with respect to said extension portion of said handle member;

said head member comprising a pair of T-shaped channels extending into said head member, a pair of T-shaped mounting members being coupled to said main portion of said scrubbing member, one of said mounting members being selectively inserted into one of said channels of said head member to selectively mount said scrubbing member to said head member;

said mounting members each including a mounting portion extending from one of said end edges toward the other of said end edges and are spaced from each of said free edges;

each of said mounting members comprising a base portion and a securing portion, said base portion being coupled to said scrubbing member, said securing portion being coupled to said base portion of the associated one of said mounting members opposite said scrubbing member such that said securing portion is positioned at an angle to aid base portion;

each of said channels of said head member comprising a vertical portion and an angled portion, said angled portion being positioned at an angle to said vertical portion of the associated one of said channels, said vertical portion of each of said channels being for slidably receiving said base portion of the associated one of the mounting members such that said angled portion slidably receives said securing portion of the associated one of said mounting member, said securing portion being inhibited from being pulled through said vertical portion of the associated one of said channels to inhibit inadvertent separation of said scrubbing member from said head member; and said scrubbing member comprising a main portion and a plurality of bristles, said main portion being selectively mounted to said head member, each of said bristles being coupled to said main portion of said scrubbing member such that each of said bristles extending outwardly from said main portion, said bristles being adapted for scrubbing against the skin of the user to clean the skin of the user.

2. A body scrubbing apparatus for scrubbing parts of a body of a user not readily accessible during bathing, the body scrubbing apparatus comprising:

a handle member being adapted for being gripped by a hand of the user;

a head member being coupled to said handle member such that said head member is adapted for being positioned opposite the hand of the user when said handle member is being gripped by the user, a channel being formed in said head member, the channel having an opening in communication with an exterior of said head member; and a scrubbing member being removably mounted to said head member, said scrubbing member being adapted for scrubbing against the user for facilitating cleaning of the user when said scrubbing member is mounted to said head member, said scrubbing member being replacable by removing said scrubbing member from said head member; wherein said handle member includes a gripping portion for being gripped by the hand of the user and an extension portion for selectively increasing and decreasing an effective length of said handle member, said extension portion extending into the channel in said head member such that said head member is selectively positionable along a length of said extension member to selectively change a distance between said gripping portion and said head member;

a locking member coupled to said head member adjacent to the opening of said channel, said locking member being configured to selectively decrease a diameter of said channel at said opening to press against and frictionally engage an exterior of said handle member to resist movement of the extension portion relative to said head member, thereby fixing the effective length of said handle member;

said head member comprising a pair of channels extending into said head member, a pair of mounting members being coupled to said scrubbing member, one of said mounting members being selectively inserted into one of said channels of said head member to selectively mount said scrubbing member to said head member;

wherein said head member has an elongated shape with a substantially transverse cross section;

wherein said channel extends longitudinally along the exterior of said head member;

wherein said scrubbing member comprises main portion defining spaced end edges and spaced lateral free edges;

wherein said extension portion extends into the channel in said head member through said transverse cross section;

wherein the pair of channels in said head member are each T-shaped, and the pair of mounting members are each located on the main portion of said scrubbing member and are each T-shaped; and wherein said mounting members each include a mounting portion extending from one of said end edges toward the other of said end edges and are spaced from each of said free edges.

3. A body scrubbing apparatus for scrubbing parts of a body of a user not readily accessible during bathing, the body scrubbing apparatus comprising:

a handle member being adapted for being gripped by a hand of the user;

an elongated head member having a substantially transverse cross section, said head member being coupled to said handle member such that said head member is adapted for being positioned opposite the hand of the user when said handle member is being gripped by the user, a channel being formed in and extending longitudinally along said head member, the channel having an opening in communication with an exterior of said head member; and a scrubbing member being removably mounted to said head member, said scrubbing member comprising a main portion defining spaced end edges and spaced lateral free edges, said scrubbing member being adapted for scrubbing against the user for facilitating cleaning of the user when said scrubbing member is mounted to said head member, said scrubbing member being replacable by removing said scrubbing member from said head member;

wherein said handle member includes a gripping portion for being gripped by the hand of the user and an extension portion for selectively increasing and decreasing an effective length of said handle member, said extension portion extending into the channel in said head member through said cross section such that said head member is selectively positionable along a length of said extension member to selectively change a distance between said gripping portion and said head member;

a locking member coupled to said head member adjacent to the opening of said channel, said locking member being configured to selectively decrease a diameter of said channel at said opening to press against and frictionally engage an exterior of said handle member to resist movement of the extension portion relative to said head member, thereby fixing the effective length of said handle member;

said head member comprising a pair of T-shaped channels extending into said head member, a pair of T-shaped mounting members being coupled to said main portion of said scrubbing member, one of said mounting members being selectively inserted into one of said channels of said head member to selectively mount said scrubbing member to said head member;

wherein said mounting members each include a mounting portion extending from one of said end edges toward the other of said end edges and are spaced from each of said free edges.

4. The body scrubbing apparatus as set forth in claim 3, further comprising:

said griping portion comprising an arcuate portion and a straight portion, said straight portion being coupled to said extension portion, said arcuate portion being coupled to said straight portion opposite said extension portion, said arcuate portion being curved such that said arcuate portion is adapted for being gripped by the user to provide a comfortable grip for the user.

5. The body scrubbing apparatus as set forth in claim 3, further comprising:

said scrubbing member comprising a main portion and a plurality of bristles, said main portion being selectively mounted to said head member, each of said bristles being coupled to said main portion of said scrubbing member such that each of said bristles extending outwardly from said main portion, said bristles being adapted for scrubbing against the skin of the user to clean the skin of the user.

6. The body scrubbing apparatus as set forth in claim 3, further comprising:

said scrubbing member comprising a main portion and a plurality of bristles, said main portion being selectively mounted to said head member, each of said bristles being coupled to said main portion of said scrubbing member such that each of said bristles extending outwardly from said main portion, said bristles being adapted for scrubbing against the skin of the user to clean the skin of the user.

7. The body scrubbing apparatus as set forth in claim 3, wherein said locking member is engagable by a hand of a user and is rotatable with respect to said handle member.

* * * * *